US005538178A

United States Patent [19]

Zink et al.

[11] Patent Number: 5,538,178

[45] Date of Patent: Jul. 23, 1996

[54] SLEEVE PACK ASSEMBLY

[75] Inventors: Robert M. Zink; Donald J. Bazany, both of Grand Haven, Mich.

[73] Assignee: Bradford Company, Holland, Mich.

[21] Appl. No.: 412,141

[22] Filed: Mar. 28, 1995

Related U.S. Application Data

[63] Continuation-in-part of Ser. No. 382,183, Feb. 1, 1995, abandoned, which is a continuation-in-part of Ser. No. 194,861, Feb. 14, 1994, abandoned.

[51] Int. Cl.[6] ..... B65D 5/32

[52] U.S. Cl. ..... 229/117.01; 229/23 R; 229/198.1; 493/115; 493/390

[58] Field of Search ..... 229/23 R, 23 BT, 229/117.01, 117.02, 198.1, 198.2, 198.3; 206/386, 600; 493/114, 115, 379, 390, 393

[56] References Cited

U.S. PATENT DOCUMENTS

| | | | |
|---|---|---|---|
| D. 271,152 | 10/1983 | Wind . | |
| 2,210,652 | 8/1940 | Dennett . | |
| 2,379,179 | 6/1945 | Petersen . | |
| 3,223,309 | 12/1965 | Chiorri | 29/198.1 |
| 3,226,008 | 12/1965 | Chiorri . | |
| 3,441,975 | 5/1969 | Shepherd . | |
| 3,941,300 | 3/1976 | Troth . | |
| 4,078,716 | 3/1978 | Harley et al. . | |
| 4,210,274 | 7/1980 | Leonard . | |
| 4,232,724 | 11/1980 | Brown . | |
| 4,296,524 | 10/1981 | Horhold et al. . | |
| 4,413,737 | 11/1983 | Wind . | |
| 4,563,381 | 1/1986 | Woodland . | |
| 4,643,314 | 2/1987 | Kidd . | |
| 4,670,938 | 6/1987 | Fowlston . | |
| 4,673,087 | 6/1987 | Webb . | |
| 4,700,862 | 10/1987 | Carter et al. . | |
| 4,763,831 | 8/1988 | Huang et al. . | |
| 4,799,727 | 1/1989 | Robbins et al. . | |
| 4,807,808 | 2/1989 | Reed . | |
| 4,828,132 | 5/1989 | Francis, Jr. et al. . | |
| 4,896,787 | 1/1990 | Delamour et al. . | |
| 5,015,028 | 5/1991 | Bonnett . | |

(List continued on next page.)

FOREIGN PATENT DOCUMENTS

| | | | |
|---|---|---|---|
| 860566 | 1/1969 | Australia . | |
| 1298440 | 6/1969 | Germany . | |
| 1486643 | 1/1970 | Germany . | |
| 2317706 | 10/1974 | Germany . | |
| 3334314A1 | 4/1985 | Germany . | |
| 35102 | 4/1986 | Germany | 229/198.1 |
| 4310895 | 10/1993 | Germany . | |
| 6612391 | 3/1968 | Netherlands . | |
| 2211906 | 7/1989 | United Kingdom . | |
| 2219036 | 11/1989 | United Kingdom . | |
| 2247717 | 3/1992 | United Kingdom . | |
| 84/01183 | 3/1984 | WIPO . | |
| 90/00662 | 1/1990 | WIPO . | |

*Primary Examiner*—Gary E. Elkins
*Attorney, Agent, or Firm*—Wood, Herron & Evans

[57] ABSTRACT

An improved sleeve pack assembly to be used to form a container comprises four vertical wall panels having hinged side flaps wherein the flaps and panels form doubled panel edge structures with securing edges along the flap edges. Four cornerposts hold the panels together and each comprises two generally perpendicular longitudinal channels which define a slot to receive the doubled edge structure and side flap of a panel. At least one channel wall includes a hooking edge, protruding inwardly of the slot, which abuts against the securing edge of the flap to lock the side flap and doubled edge structure into the cornerpost slots to hold the wall panels together into a sleeve pack assembly. In a collapsible embodiment of the sleeve pack, the longitudinal channels are in separate pieces which are hinged together to form a hingable cornerpost. The collapsible sleeve pack assembly further includes two opposing wall panels which are scored to be folded, and the sleeve pack assembly is collapsible. A rigid sleeve pack assembly embodiment utilizes a one piece cornerpost having two longitudinal channel sections to receive the doubled panel edge structures and side flaps.

31 Claims, 4 Drawing Sheets

U.S. PATENT DOCUMENTS

| | | | |
|---|---|---|---|
| 5,042,713 | 8/1991 | Stafford | 229/23 R |
| 5,050,793 | 9/1991 | Graham, Jr. | 229/23 R |
| 5,133,108 | 7/1992 | Esnault . | |
| 5,181,611 | 1/1993 | Liebel | 229/918 |
| 5,292,060 | 3/1994 | Focke et al. | 229/23 BT |
| 5,318,219 | 6/1994 | Smith | 229/23 R |
| 5,351,846 | 10/1994 | Carter . | |
| 5,361,923 | 11/1994 | Knight, IV et al. . | |
| 5,370,256 | 12/1994 | Fourie et al. . | |
| 5,377,857 | 1/1995 | Taravella et al. . | |
| 5,395,002 | 3/1995 | Adler . | |
| 5,398,376 | 3/1995 | Pollack . | |

SLEEVE PACK ASSEMBLY

CROSS REFERENCE TO RELATED APPLICATIONS

This application is a continuation-in-part of application Ser. No. 08/382,183 entitled "Sleeve Pack Assembly" and filed Feb. 1, 1995, now abandoned, which is a continuation-in-part of application Ser. No. 08/194,861 entitled "Sleeve Pack Assembly" filed Feb. 14, 1994, now abandoned, which applications are completely incorporated herein by reference in their entireties.

FIELD OF THE INVENTION

This invention relates generally to reusable containers, and more specifically to an improved sleeve pack assembly to be used with a pallet base and cover to form collapsible and rigid reusable containers.

BACKGROUND OF THE INVENTION

Relatively large reusable containers are utilized by manufacturers to ship a variety of different products to their customers. For example, in the automobile industry, a plant assembling a particular automobile might utilize a number of different parts manufacturers. These manufacturers ship their respective parts to the plant in reusable containers where the parts are then assembled together into a finished automobile. The reusable containers are often returned to the parts manufacturers for use in further shipments.

Generally, construction of such shipping containers includes a pallet base, a cover and a sleeve pack which is situated between the base and cover to form the sidewalls of the container.

Such a design provides a versatile and lightweight shipping container which may be reused time and again. The vast majority of sleeve packs used today are made of heavy grades of triple wall corrugated paper, such as paper in the 1,000 pound bursting strength range. Such paper wall sleeve packs are functional if kept dry; however, as may be appreciated, moisture damages the strength of the paper wall and degrades the overall reliability of the sleeve pack. Accordingly, there is a need for a sleeve pack which can be stored outdoors as necessary when indoor storage space is not available.

Plastic sleeves have been utilized for weather-proof containers; however, the existing plastic sleeve packs have generally been inadequate. Specifically, the single layer plastic making up the sleeves is not capable of achieving adequate stacking strength, and therefore, several sheets of the single wall plastic material have to be laminated together. Often even the laminated sheets are not strong enough to support the stacking loads required, and they have to be reinforced by another material. The increased number of sheets and strengthening layers increases the expense of the containers and the complexity of their assembly.

Sleeve packs, whether plastic or paper, generally require reinforcing structures at their corners to hold the sleeve pack sidewalls together and to provide adequate support for the stacked loads. When shipped and stored, numerous containers will usually be stacked upon one another. The prior art shows several different corner support structures for reinforcing a container and enhancing its support strength. For example, the patent of Kidd, U.S. Pat. No. 4,643,314 discloses a container construction which utilizes hinged corner elements formed from a web extending between two cup-shaped structures. However, the sidewalls must be secured to the cup-shaped structures by adhesion requiring some sort of bonding adhesive and an additional and messy step when fabricating the sleeve pack. Furthermore, the strength of construction depends upon the adhesive bond.

The patent of Webb, U.S. Pat. No. 4,673,087 discloses a reusable container system having sidewalls with endmost strips that grip T-shaped ribs formed in the corner connectors. Such a design is both difficult to assemble and also expensive to manufacture as the sidewall material has to be specially formed to integrally fit with the ribs of the corner connector. Furthermore, assembly requires proper alignment of the strips and ribs.

The patent of Carter et al, U.S. Pat. No. 4,700,862 discloses a sidewall structure for a stackable bin. However, the corner structure is nothing more than an extension of the sidewall and must be adhesively bonded to the adjacent sidewall. As may be appreciated, such a design is both impractical from an assembly standpoint because of the necessity of adhesive, and inherently weak, as the support structure is essentially just additional sidewall material as opposed to a stronger, more rigid structure.

The container wall sleeves and corner hinges of Francis, Jr. et al, U.S. Pat. No. 4,828,132 requires inner and outer sidewall panels and a corner member which is capable of gripping two panels simultaneously. The increased number of panels increases the cost of the sleeve as well as the difficulty and time required to assemble and disassemble such a sleeve from its component parts. German Patent No. 1298440 discloses solid sidewalls which include a slot machined into the sidewall edges. An inside latching structure of the corner connector fits inside the slot to hold the sidewalls in the corner connector. This construction requires special side panels specifically constructed for the particular reinforcing corner structures of the container making the container more expensive to manufacture.

Accordingly, there is a need for a simple sleeve pack with corner structures which may be assembled quickly, easily, and without additional parts, adhesives or critical alignments. It is also desirable to have a sleeve pack which may be assembled starting with essentially flat sidewalls that do not have to be specially formed or molded to cooperate with the corner structures. It is further desirable that the pack be readily assembled and disassembled when necessary and have adequate supporting strength at the corners.

Additionally, there is also a need for a sleeve pack assembly which is easily recyclable. More specifically, the component parts of the sleeve pack should be able to be broken down quickly into individual material units which might be recycled and reused. The growing concern over the environment has made recyclability of a product a desirable feature. Furthermore, although recycling is not mandatory in the United States, it is foreseeable that the United States may adopt a practice where a container must be constructed such that it is easy to break down into separate recyclable pieces, an approach which has already been adopted in Europe.

There is also a need for a durable, collapsible sleeve pack which may be quickly and easily assembled from its component parts and then readily assembled into a collapsible and reusable container. Collapsible sleeve packs and containers are particularly important because they may be collapsed and return-shipped to the manufacturer in a form which occupies only a fraction of the volume occupied by the completely assembled container. Generally, shipping containers may be shipped back to the parts manufacturer and reused; however, the return shipping is relatively expensive because empty uncollapsed containers take up the same shipping volume as containers filled with parts. The cost of shipping and storage is determined by volume, and therefore, the same cost is incurred for an empty container as for a full container. Therefore, if the sleeve pack may be collapsed when the container is disassembled, it will amount to a substantial savings in return shipping costs.

Generally, collapsible sleeve packs have two opposing sidewalls which are hinged at their center. All of the end walls are then attached together into a sleeve pack at the corners by hinging corner structures. To collapse such a sleeve pack, the hinged sidewalls are hinged inwardly at their centers and sandwiched between the unhinged sidewalls. The hinging corner structures allow the collapsed sleeve pack to lie flat and occupy a volume which can be as little as 10% to 25% of the volume occupied by the assembled sleeve pack and container.

However, like the rigid containers of the prior art, the prior art collapsible containers utilize corner support structures which are difficult to assemble and disassemble with the various sidewalls. Furthermore, the prior art collapsible containers require rigid hinged structures at the centers of the hinging sidewalls further increasing the cost, weight, and complexity of the sleeve pack and the overall difficulty of its assembly. As a result, there is further a need for a collapsible sleeve pack which may be assembled and disassembled easily and quickly without adhesives, additional external parts, or special tools. Further it is desirable to have a sleeve pack which starts with ordinary flat sidewalls that are die cut and need not be specially formed or molded to have attaching structures. There is further need for a collapsible sleeve pack which meets all of these objectives and still provides ample support strength for use with stacked shipping containers.

SUMMARY OF THE INVENTION

The sleeve pack assembly of the present invention comprises a rectangular sleeve fabricated from four separate sidewall boards interconnecting at their corners by rigid cornerposts. The invention encompasses both a rigid sleeve pack embodiment and a collapsible sleeve pack embodiment.

The collapsible sleeve pack embodiment of the present invention provides a collapsible rectangular sleeve pack which may be collapsed to lie flat such that it may be inexpensively shipped back to the manufacturer. The collapsible rectangular sleeve pack starts with four, flat sidewall panels. The vertical side edges of each panel are then folded along longitudinal vertical fold lines to form side flaps with free flap edges. The flaps are folded toward one face surface of the panel and the flap and panel cooperate to define a doubled panel edge structure having a securing edge at each free flap edge. Two opposing sidewall panels of the sleeve are scored proximate the center of the panel with a longitudinal, vertical score line which extends generally parallel with the vertical doubled panel edge structures and side flaps. The scored panels are foldable in half without any hinging structure. Four elongated cornerposts hold the sidewalls together at their side edges into a sleeve.

Each cornerpost of the collapsible sleeve pack embodiment comprises two elongated channel pieces, each having two opposing channel walls which define vertical slots dimensioned to receive the side flaps and doubled panel edge structures of the panels. Each channel piece further has a longitudinal flange which preferably extends along the length of the cornerposts, coextensive and parallel with one of the channel walls. The two channel pieces of a cornerpost are hingedly jointed to each other by a flexible strip which is adhesively connected to the longitudinal flanges of the channel pieces to form a unitary cornerpost. The hinged channel pieces are flexible with respect to each other along the strip.

At least one of the channel walls of each channel piece has a hooking edge protruding inwardly of the channel piece and into the slot generally perpendicular with the channel walls. To assemble the sleeve pack, a side flap and doubled panel edge structure of a panel are pushed into a channel piece slot. The perpendicular hooking edge catches the securing edge of the flap and abuts against the securing edge to hold the doubled panel edge structure and flap in the cornerpost. Securing rivets are inserted into the cornerposts to further hold the sidewall panels therein. The hingable cornerposts thereby hold all of the sidewall panels together in the form of a rectangular sleeve with the adjacent wall panels being flexible with respect to each other due to the flexible cornerpost structure. The cornerposts may be assembled together before the panels are inserted therein, or the individual channel pieces may be snapped to the panels and later connected by the flexible hinging strip.

In an alternative embodiment of the collapsible sleeve pack, each flexible cornerpost includes a male hinge piece having a male extension portion which is configured to be received by the female extension portion of the corresponding female hinge piece. The male and female hinge pieces provide hinged movement along the length of the cornerpost. Each hinge piece has opposing channel walls to define a channel or slot to receive a double panel edge structure and side flap of a wall panel.

The assembled collapsible sleeve pack is easily collapsed into a flat sleeve pack by folding the scored end panels inwardly toward the center of the sleeve pack while bringing the two opposing unscored panels toward each other thereby sandwiching the folded hinged panels between them.

Therefore, the unique end panel and cornerpost structure of the present invention provides a collapsible sleeve pack which may be readily and easily assembled and disassembled and folded to occupy a small volume. Furthermore, the design provides a collapsible sleeve pack which is durable, weather resistant, and able to withstand heavy loads stacked thereon when assembled. Furthermore, the collapsible sleeve pack is readily assembled with no tools, liquid adhesives or other external parts other than the securing rivets.

The rigid sleeve pack embodiment utilizes four sidewalls each made of a single layer of double-faced, corrugated plastic board which are juxtaposed with each other along their vertical side edges. Like the collapsible embodiment, the panels are folded at their vertical edges to form side flaps which define a doubled edge panel structure having a securing edge at each free flap edge. The cornerposts hold the panels together at their side edges into a sleeve.

The cornerpost of the rigid sleeve pack is an elongated vertical member formed of a rigid material which has two elongated longitudinal channel sections formed therein. The channel sections are generally perpendicular with each other along their lengths to form a longitudinal corner along the length of the cornerpost. Each channel has opposing walls which define a vertical slot dimensioned to receive the side flap and doubled panel edge structure of a sidewall panel.

At least one of the channel walls of each channel section has a hooking edge protruding inwardly of the channel section and into the slot generally perpendicular with the wall. The hooking edge extends along the length of the channel and, like the hooking edge of the collapsible sleeve pack, is configured to catch and abut against the securing edge of the side flap structure to lock the side flap and doubled panel edge structure into the channel slot.

With the unique hooking edge and end flap design of the sleeve pack, the various sidewall panels may be "snapped" quickly and easily into the channel slots of the cornerposts. Securing rivets then fix the end flap in the channels of the cornerposts. The panels are held securely within the cornerposts in the form of a sleeve pack which may be placed on a pallet base and covered by a lid to form a strong, durable container. The cornerposts in combination with the double-faced, corrugated plastic sidewalls and the doubled panel edge structures form a sleeve pack which may be reused time and again and exposed to moisture and other elements without jeopardizing its support strength.

Only one hooking edge is necessary within a cornerpost channel; however, a hooking edge might be utilized on each channel wall to hook the elongated securing edge and lock the panel into the cornerpost. In that way, the end flap may be folded toward either of the panel faces when assembling the sleeve pack. The resulting sleeve pack is easy to assemble and disassemble without requiring any liquid adhesives, special tools, or other external parts. The sleeve pack may be disassembled into its component pieces which may then be easily recycled if desirable. Further, the sleeve pack is durable, reusable, and able to withstand a heavy load so that containers made from the sleeve packs of the present invention may be safely stacked on top of each other without subsequent collapse of the bottom containers of the stack.

Hence, the invention presents reusable rigid and collapsible sleeve packs which are inexpensive to manufacture, easy to assemble and disassemble and durable enough to be reused time and again. The sleeve packs are lightweight yet strong enough to be used with heavy-duty shipping containers and may be easily recycled when disassembled.

The above and other objects and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
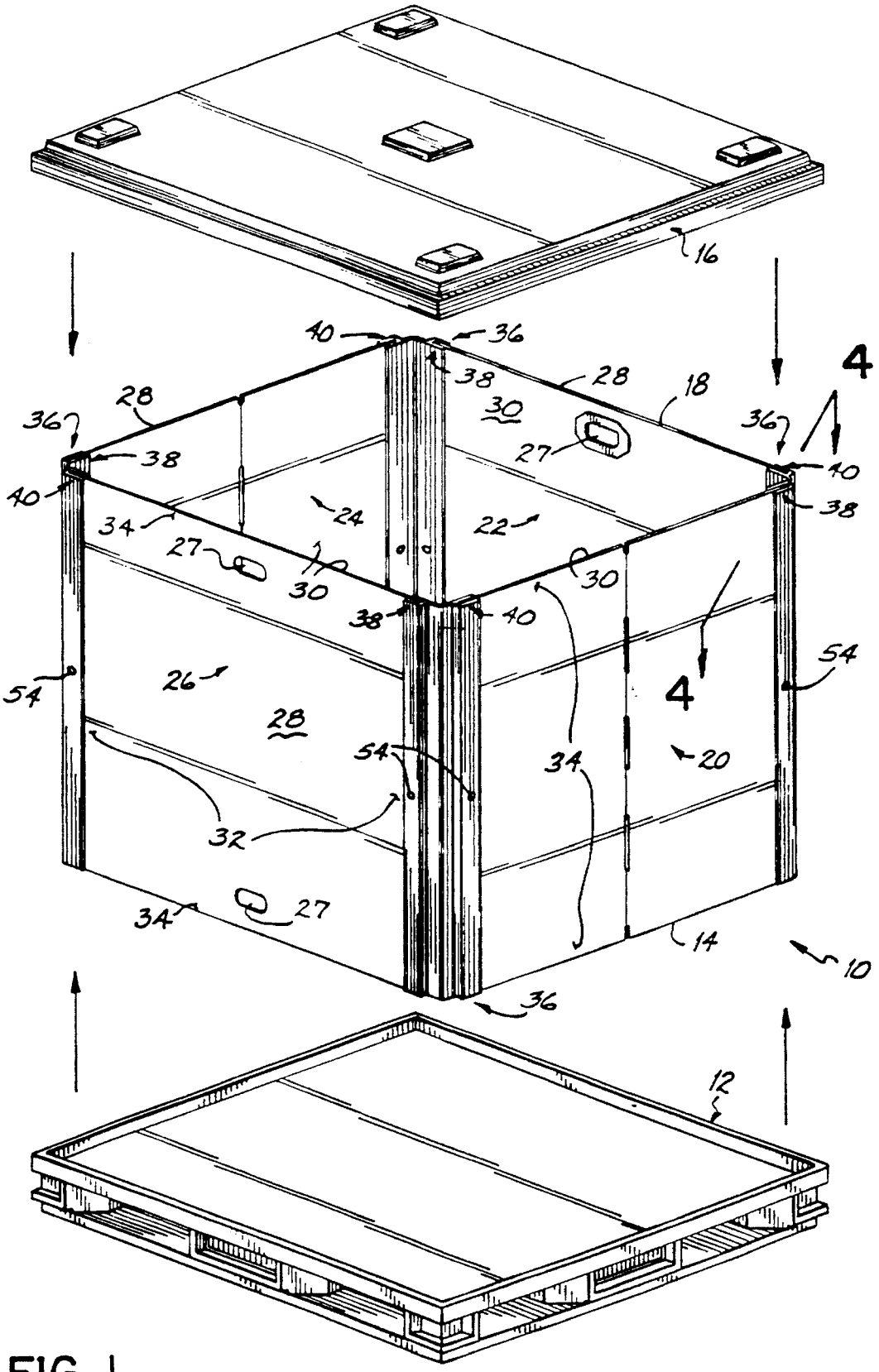
FIG. 1 is an exploded view of the collapsible sleeve pack embodiment of the present invention used with a pallet base and cover.

FIG. 1 shows a collapsible sleeve pack 10 of the present invention as part of an overall reusable shipping container. Specifically, sleeve pack 10, assembled as a rectangular sleeve, fits into a container pallet base 12 at its bottom end 14 and is covered by the container cover 16 at its top end 18. The assembled container comprising sleeve pack 10, base 12 and cover 16 may then be filled with parts and shipped to a customer. The container is formed to be stackable and therefore, sleeve pack 10 is designed to withstand a large amount of compressive force between its top and bottom ends 14, 18.

Figure 2:
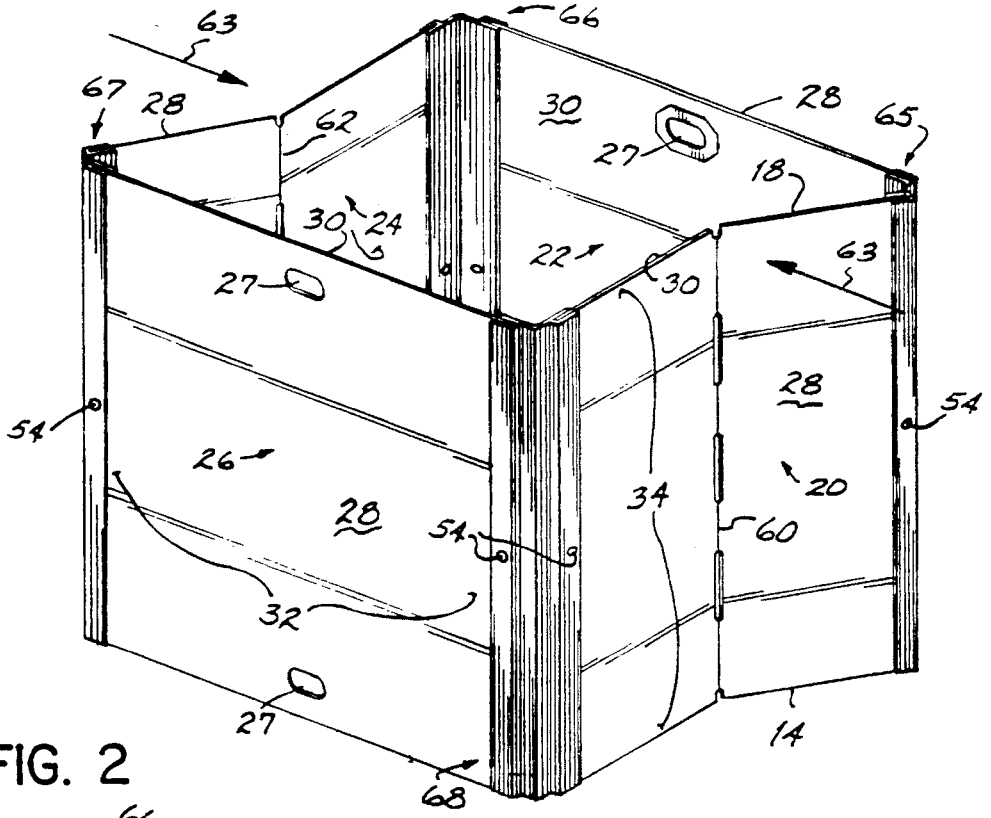
FIG. 2 is a perspective view of the collapsible sleeve pack of FIG. 1 being collapsed.
Figure 3:
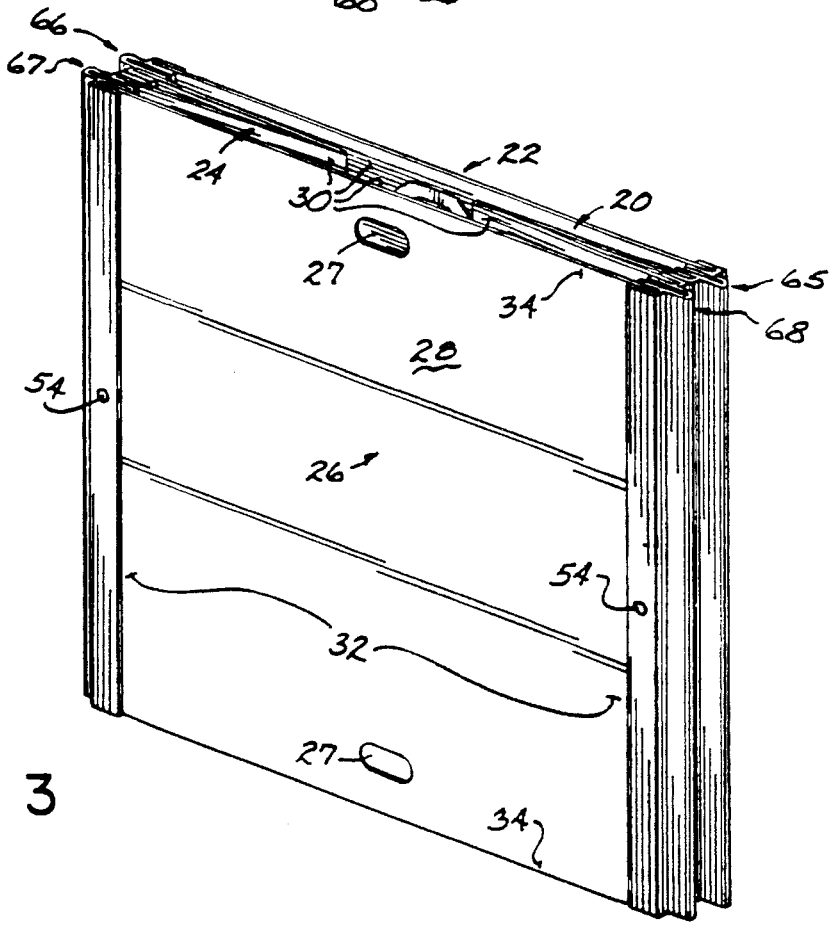
FIG. 3 is a perspective view of the collapsible sleeve pack of FIG. 1 in a completely collapsed position.

Sleeve pack 10 is collapsible and comprises four sidewall panels 20, 22, 24, 26. Each panel is double-faced and has an outside face 28 and an inside face 30 and opposing vertical side edges 32 and horizontal edges 34. When collapsible sleeve pack 10 is assembled, the vertical side edges 32 of adjacent panels are juxtaposed with each other to form the corners of the rectangular sleeve pack 10. The sleeve pack panels 20, 22, 24, 26 are held together at the corners by four cornerpost structures 36. Since sleeve pack 10 is collapsible, the cornerpost 36 are hinged so that the sleeve pack 10 may be collapsed as illustrated in FIGS. 2 and 3 and further discussed hereinbelow. Handles 27 are formed in panels 22, 26 to facilitate assembly of the sleeve pack 10 and the container as well as handling in the collapsed state of the sleeve pack.

Figure 4:
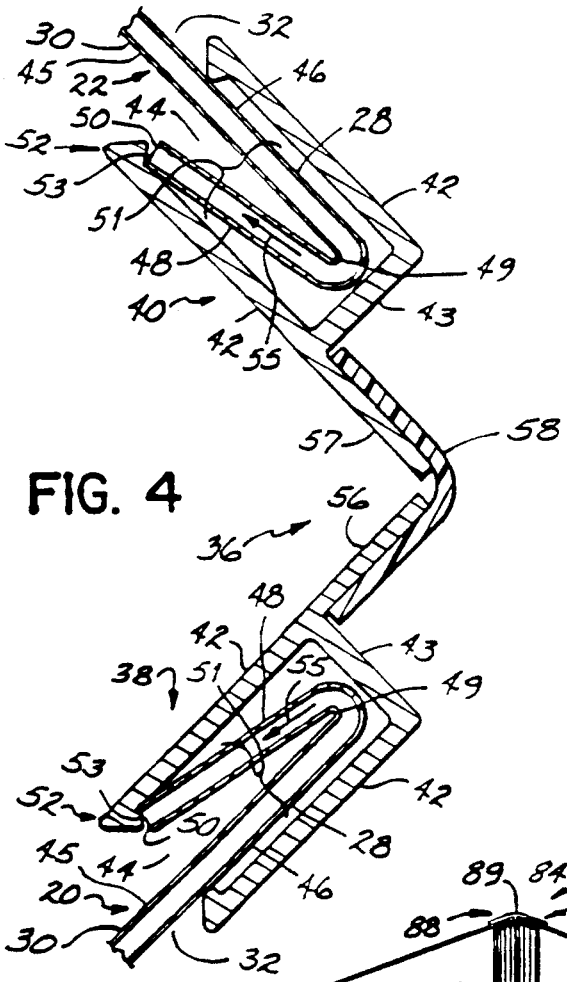
FIG. 4 is a top cross-sectional view along lines 4—4 of the flexible cornerpost utilized with the collapsible sleeve pack of FIG. 1.

Referring now to FIGS. 1 and 4, each cornerpost 36 utilized to hold the collapsible sleeve pack 10 together comprises two longitudinal channel pieces 38, 40. Each channel piece, such as channel piece 38, has opposing channel walls 42 extending from a base section 43. The opposing walls 42 form the channel piece 38 and extend the length of the cornerpost 36 to define a vertical channel or slot 44 in the channel piece 38. Channel piece 38 holds the vertical side edge 32 of a sidewall panel 20, 22, 24 or 26 to form sleeve pack 10.

Sidewall panel 20 is a double-faced corrugated plastic board having opposing rigid plastic face sheets 45, 46 which sandwich a plurality of corrugations (not shown) therebetween. The panels are die cut and do not need to be specially formed. To secure the panel 20 in a cornerpost, a portion of a vertical side edge 32 of panel 20 is folded along a longitudinal fold line 49 toward the inward face 30 of panel 20 to define a side flap 48. Side flap 48 has a free edge 50 and cooperates with panel 20 to form a doubled panel edge structure 51. The structure 51 includes a securing edge at the free edge 50 of flap 48. The securing edge 50 extends longitudinally down the vertical side 32 of panel 20. The doubled panel edge structure 51 provides increased support strength at the vertical side of the panel 20 and the corners of sleeve pack 10.

To secure panel 20, or any other panel 22, 24, 26 to channel piece 38, the vertical side edge 32 of the panel, including flap 48 and doubled edge structure 51, are inserted into slot 44 of channel piece 38. A hook protrusion 52 is raised along at least one vertical channel wall 42 to define a hooking edge 53. Hooking edge 53 protrudes into slot 44 and extends preferably the length of channel piece 38. The channel piece walls 42 and panel flap 48 are dimensioned in width such that when flap 48 and doubled edge structure 51 are inserted into slot 44, the securing edge 50 of flap 48 is aligned with protrusion 52 of hooking edge 53. When edge flap 48 is folded and pressed into slot 44, the resiliency of the double-faced corrugated plastic panel 20 causes the folded flap 48 to spring away from panel 20 at fold line 49 and contact hooking edge 53 at the flap securing edge 50. In that way, flap 48 is depressed when inserted into slot 44 and then springs outward away from face 30 of panel 20 and toward one of the channel walls 42. Hooking edge 53 catches securing edge 50 and pushes against the securing edge 50 to hold panel 20 within channel piece 38. Therefore, to connect cornerpost 36 and panel 20, flap 48 and doubled edge structure 51 are simply snapped into slot 44 and held there by the hooking action of edges 50 and 53. The hooking edge might be formed on both channel walls 42 of channel piece 38 as shown in FIG. 4. This will allow the cornerpost to hold a panel side edge regardless of whether the flap 48 is folded to the inside panel face 30 or outside panel face 28.

The rigid plastic face sheets 45, 46 aid in securing panel 20 to channel piece 38. The plastic face sheets 45, 46, along their side edges, provide lateral force along line 55 against hooking edge 53. The strength of the plastic face sheets 45, 46 in combination with the overall rigidity of panel 20 prevents the panel from becoming unhooked and pulling out of slot 44 and away from cornerpost 36. Therefore, a very strong and secure connection is made between panel 20 and channel piece 38 without the necessity of adhesives or additional securing structures as required by the prior art. A similarly strong connection exists between panel 22 and channel piece 40 of FIG. 4. With all of the panels secured in a cornerpost, the sleeve pack is complete.

A rivet or other fastening structure, such as rivet 54, might be utilized to extend through the walls 42 of channel piece 38 and through panel 20 and flap 48 to further secure the vertical edge of the panel within the channel piece once the sleeve pack has been assembled. The cornerpost connection is easily disassembled by removing rivet 54 and sliding panel 20 out of slot 44. When disassembled, the sleeve pack individual parts may be separated into either plastic or metal parts thereby facilitating their easy recyclability.

To form unitary cornerposts 36 and completely assemble the sleeve pack 10 to be used with a container, the channel pieces 38, 40 are placed perpendicular with each other to define a corner. Preferably, panels 20, 22 have been snapped into their respective channel pieces 38, 40 so that the panels may be partially assembled into a rectangular sleeve configuration. Each channel piece 38, 40 includes a longitudinal flange, such as flange 56, which extends from channel piece 38. Flanges 56, 57 are preferably coextensive with and parallel one of the channel walls 42 of the channel pieces 38, 40, respectively. Flanges 56 and 57 are attached together to form a unitary, hinging cornerpost 36 by a flexible strip 58 which preferably extends completely down one side of both flanges 56, 57 and therefore down the length of the entire cornerpost 36. Flexible strip 58 allows the channel pieces 38, 40 to be hinged with respect to one another. The strip 58 is preferably a fabric strip with adhesive on one side which may be easily adhered to flanges 56, 57. A suitable adhesive strip for such purposes is one fabric side strip of a hook and loop fastener, such as Velcro™. With the hinging cornerpost 36, the sleeve pack may be collapsed as illustrated in FIGS. 2 and 3. While the assembly steps of the sleeve pack 10 have been illustrated as first connecting panels to channel pieces and then connecting channel pieces together, the sleeve pack might also be assembled by first fixing the two channel pieces 38, 40 together with strip 58 into a unitary cornerpost 36 and then snapping the panels into the cornerposts. A cornerpost like cornerpost 36 is used at each corner of sleeve pack 10.

The collapsible sleeve pack 10 in various collapsed stages is shown in FIGS. 2 and 3. Specifically, referring to FIG. 2, two of the opposing sidewall panels, 20 and 24, are scored along center score lines 60, 62. The double-faced corrugated plastic panels 20, 24 are foldable along the score lines 60, 62, respectively. The panels are foldable but remain whole at the score lines 60, 62, and therefore, the hinged panels 20, 24 do not require any additional hinging hardware. The strength of the plastic face sheets 45, 46 and the corrugated plastic keeps the panels from tearing at the score lines 60, 62. As illustrated in FIG. 2, with the panels scored, they may be folded to extend inwardly at their centers toward the middle of sleeve pack 10 in a direction designated by arrow 63. Scored panels 20 and 24 are folded inwardly and the panels are hinged at the cornerposts 65, 66, 67, 68.

While opposing panels 20, 24 are folded along score lines 60, 62, the non-scored opposing sidewall panels 22, 26 are brought toward each other. Referring now to FIG. 3, panels 20, 24 are folded and panels 22 and 26 are brought together to sandwich the folded panels therebetween to provide a flat, collapsed sleeve pack 10. The hinged channel pieces of each corner post are generally parallel with each other when the sleeve pack is collapsed. To reform the sleeve pack from the collapsed state, panels 22 and 26 are moved away from each other while panels 20, 24 are again hinged except in a direction opposite that designated by arrow 63. Panel handles 27 are useful to facilitate assembly of the sleeve pack, collapsing and reforming of the sleeve pack, and assembly of the overall reusable container using sleeve pack 10.

Therefore, the collapsible sleeve pack 10 of the present invention provides a strong, lightweight sleeve pack which is easily and readily formed and collapsed as necessary for shipping of parts, and return shipping of the collapsed sleeve pack. No tools, liquid adhesives or external pieces are necessary in order to assemble the sleeve pack from its component parts other than securing rivets. The combination of the double-faced corrugated plastic panels, the doubled panel edge structures and the novel flexible cornerposts of the present invention provide a strong collapsible sleeve pack which may be utilized in containers required to withstand high compressive forces. The panels, once snapped into the cornerposts, are held fast by the unique design of the channel pieces and hooking edge in cooperation with the folded end flaps and flap securing edge. Furthermore, when it is desirable to completely disassemble the sleeve pack, the flaps and securing edges of the individual panels may be easily removed out of their respective cornerpost slots by removing the rivet 54 and sliding the cornerposts off of the corrugated plastic panel. The plastic side panels and rigid cornerpost can withstand moisture and other elements and still retain their rigidity and supportive strength, while the individual pieces of the disassembled sleeve pack may be easily recycled if desired.

Figure 5:
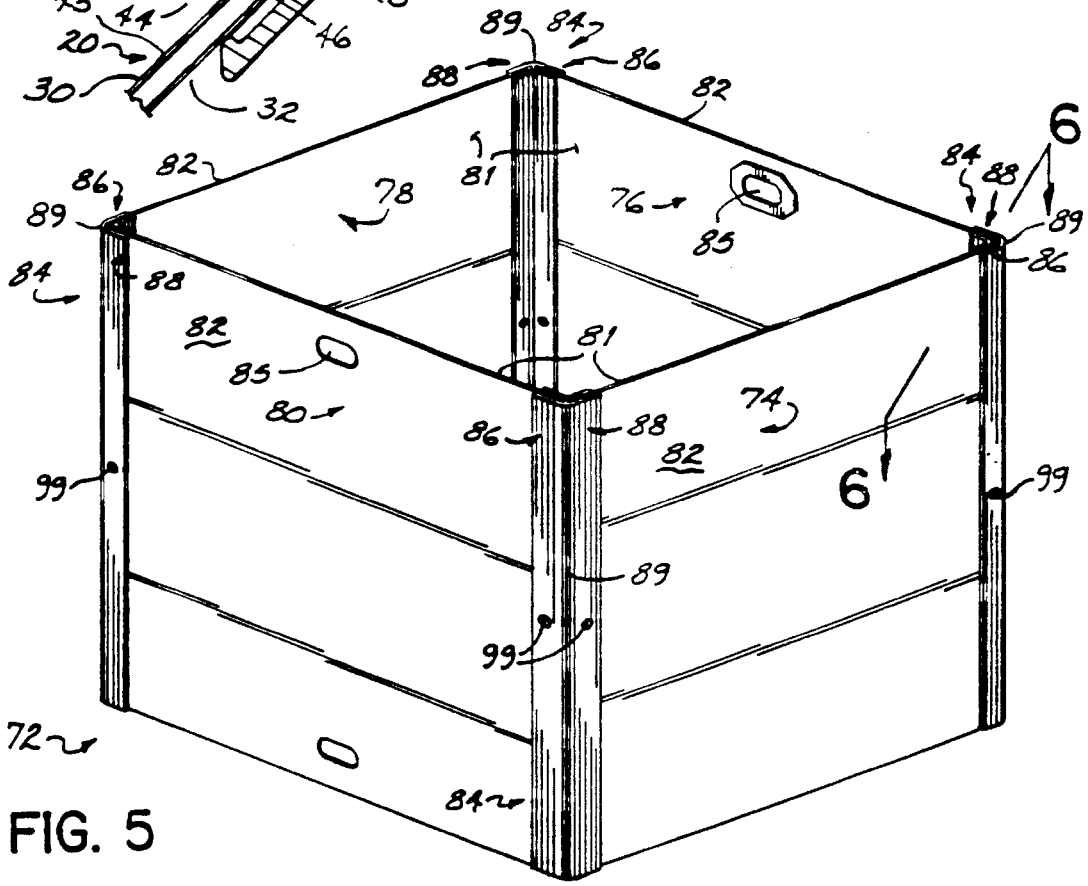
FIG. 5 is a perspective view of the rigid sleeve pack embodiment of the present invention.

An alternative embodiment of the present invention is a rigid sleeve pack as shown in FIG. 5. Sleeve pack 72 is not collapsible, and therefore the four panels 74, 76, 78 and 80 are not scored to be collapsed. Rather, each of the panels is generally continuous along both inside and outside faces 81, 82, respectively. Panels 74, 76, 78 and 80 are held together into a rigid sleeve pack by cornerposts 84. Handles 85 may be formed in the panels to facilitate assembly and disassembly of sleeve pack 72 and assembly of a container using the sleeve pack. Additionally, the handles 85 facilitate handling of a collapsed sleeve pack and visual inspections of the contents of the erected sleeve pack.

Figure 6:
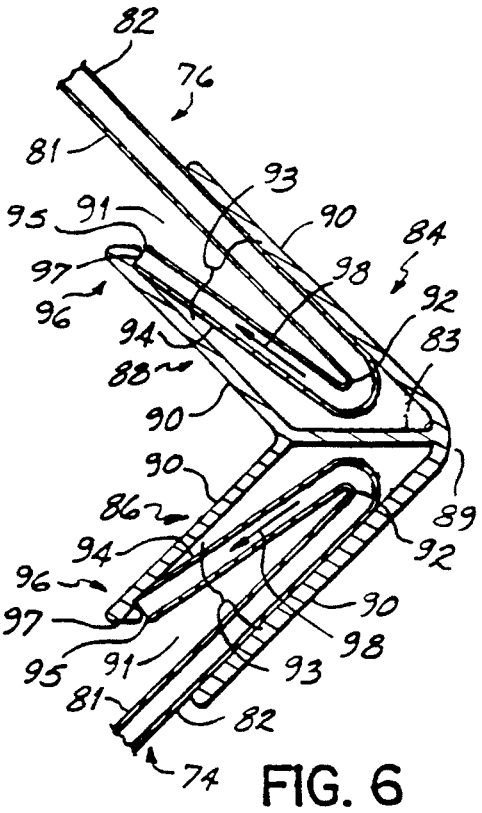
FIG. 6 is a top cross-sectional view along lines 6—6 of the rigid cornerpost utilized with the rigid sleeve pack of FIG. 5.

Referring now to FIG. 6, each rigid elongated cornerpost 84 includes two generally perpendicular longitudinal channel sections 86, 88. The channel sections 86, 88 meet at one end thereof and are connected by a flat rigid vein 83 to form a corner 89 along the length of the cornerpost 84. The channel sections 86, 88 are oriented generally perpendicular with each other to define a right angle corner. Each of the channel sections 86, 88 has opposing channel walls 90 which define a vertical channel or slot 91 similar to vertical slot 44 of the flexible cornerposts of sleeve pack 10.

A portion of the vertical side edge of a panel, such as panel 74, is folded along a longitudinal fold line 92 toward a face of panel 74 to form a side flap 94. Similar to the panels of the collapsible embodiment described above, flap 94, in combination with panel 74, forms a doubled panel edge structure 93 which includes a securing edge 95 on flap 94. The doubled edge structure 93 provides increased support strength at the corner of the sleeve pack 84 to supplement the strength of the cornerpost.

To secure panel 76 or the other panels 74, 78, 80 to cornerpost 84, flap 94 and doubled edge structure 93 of panel 74 are inserted into slot 91 of channel section 86. A hook protrusion 96 is raised along at least one vertical wall 90 to define a hooking edge 97. As similarly described hereinabove with respect to the collapsible sleeve pack 10, when flap 94 and doubled edge structure 93 are placed in channel section 86, securing edge 95 of flap 94 abuts against hooking edge 97 and the hooking edge pushes against the securing edge 95 to hold panel 74 in slot 91. Therefore, to connect panel 74 to cornerposts 84, flap 94 and doubled edge structure 93 are simply snapped into slot 91 and held there by the hooking action of edges 95 and 97. The plastic face sheets of the corrugated panel 74 provide lateral force at securing edge 95 against hooking edge 97 in the direction of arrow 98. Panel 76 is similarly inserted and held within channel section 88. Thereby, the cornerposts 84 hold panels 74, 76, 78, 80 into a rigid sleeve pack assembly 72. Again, a rivet such as rivet 99 might be utilized in the cornerposts to further secure the vertical side edges of the panels within the respective channel sections.

The resiliency of the double-faced corrugated plastic panels keeps flap 94 abutted against hooking edge 97, because the flap 94 springs in the direction of the hooking edge 97 keeping edges 95 and 97 aligned. To remove the panels from the cornerposts, the rivets 99 are removed and the cornerposts slide off of the side panels. Therefore, like the collapsible sleeve pack 10, the rigid sleeve pack 72 may be quickly assembled and disassembled without the use of tools. The combination of the double-faced corrugated plastic panels and the novel rigid cornerpost structure of sleeve pack 72 provides a strong sleeve pack which forms a container able to withstand a large amount of compressive force. The panels, once snapped into the cornerposts are held fast by the unique design of the channel pieces and the strength of the double-faced corrugated plastic.

Figure 7:
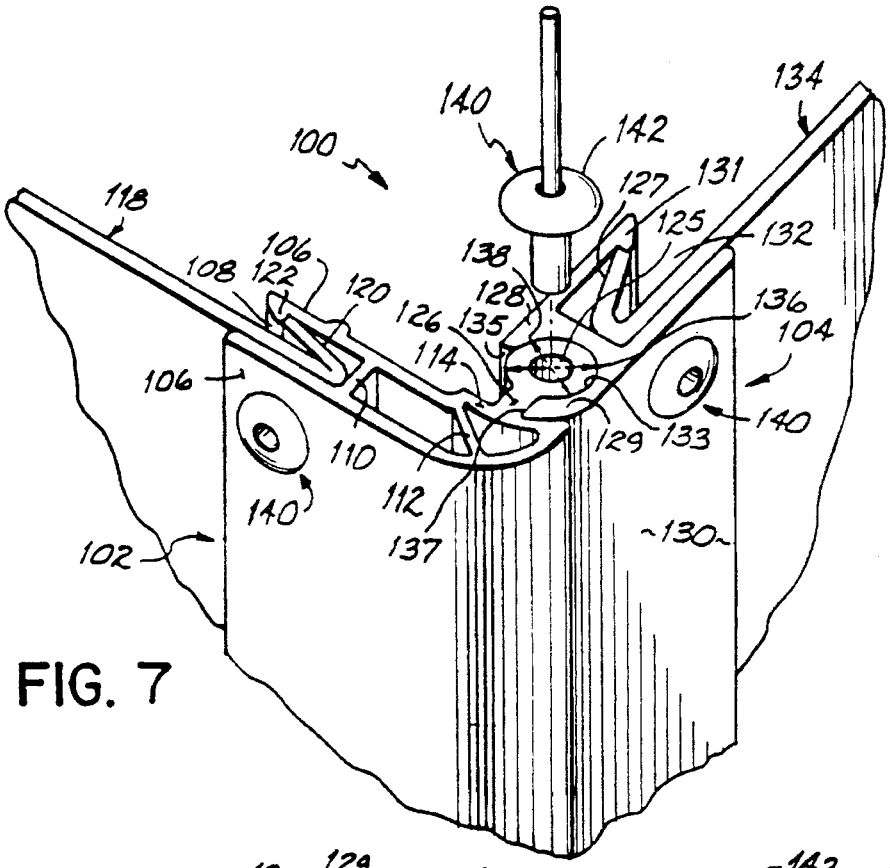
FIG. 7 is a perspective view of an alternative embodiment of the flexible cornerpost of the invention.
Figure 8:
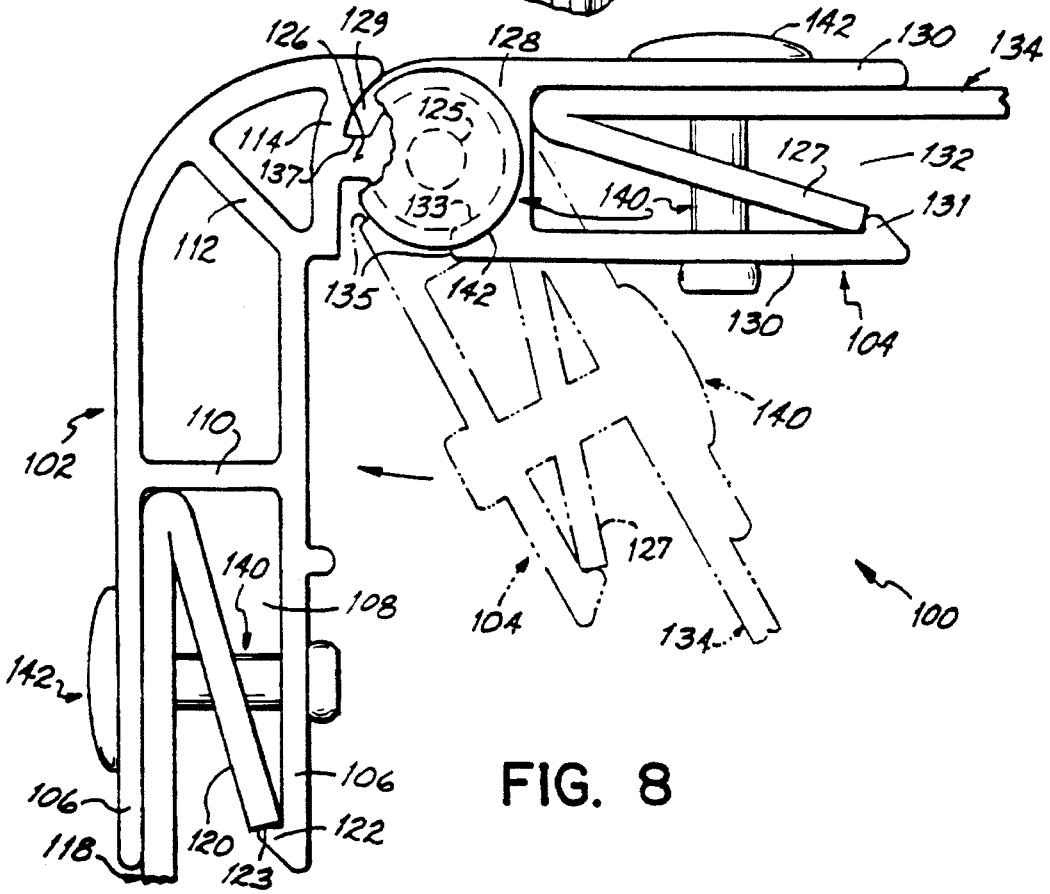
FIG. 8 is a top view of the flexible cornerpost of FIG. 7.

FIGS. 7 and 8 illustrate another alternative embodiment of the flexible cornerpost of the invention. Cornerpost 100 is similar to cornerpost 36 and is used to create a collapsible sleeve pack as described hereinabove. Cornerpost 100 includes a male hinge piece 102 and a female hinge piece 104. As illustrated in FIG. 7, the male hinge piece 102 includes opposing channel walls 106 which define a channel or slot 108 therebetween. Elongated reinforcement walls 110, 112 extend between the channel walls 106 along the length of the male hinge piece 102 in order to reinforce the male hinge piece 102. The channel walls 106 are curved at one end thereof and meet a base section 114 which extends generally parallel to channel walls 106 and spaced therefrom (see FIG. 8). The other end of the male hinge piece 102 is open to define elongated channel 108 which receives a sidewall panel 118 with a sideflap 120 which fits within channel 108 in accordance with the present invention to form a sleeve pack. At least one channel wall 106 includes a hook protrusion 122 which abuts against a securing edge 123 of side flap 120 of panel 118 to insure that panel 118 is securely fastened into channel 108 of the male hinge piece 102.

Male hinge piece 102 includes a cylindrically shaped male extension portion 124 which extends from base section 114 generally perpendicular to base section 114 and the channel walls 106. The male extension portion 124 preferably extends along the length of the male hinge piece 102, however, it may be divided into various laterally spaced sections along the length (not shown) of the male hinge piece 102. Male portion 124 is connected to base section 114 by an extension 126 which spaces the male portion 124 from the base section 114.

The female hinge piece 104 receives male extension portion 124 in hinged relationship to allow hinging of the female hinge piece 104 with respect to the male hinge piece 102 for a flexible cornerpost 100. The female hinge piece 104 includes a base section 128 and channel walls 130 which extend generally perpendicular to base section 128 and parallel with each other in order to form a channel 132 in the female hinge piece 104. At least one of the channel walls 130 includes a hook protrusion 131 to secure the folded side flap 127 of a panel 134. A female extension portion 129 extends from base 128 and is generally cylindrical in shape to receive the preferably cylindrical male portion 124 as illustrated in FIGS. 7 and 8. Female extension portion 129 extends from one side of the base 128 in a semi-circular arc for approximately 180°. The female extension portion 104 then extends in an approximately 90° semi-circular arc from an inner side of base 128. As illustrated in FIGS. 7 and 8, the semi-circular arcs extend approximately 270° around the male extension portion 124 to thus allow approximately 90° of movement of one hinge piece with respect to the other.

As illustrated in FIG. 8, the transverse cross-section of the cylindrical male extension portion 124 is circular. To allow smooth hinging the outermost diameter of male extension portion 124, as illustrated by reference numeral 136, is slightly less than the circular cross section 138 of the cylindrical cavity 133 which is defined by female extension portion 129. To assemble the male hinge piece 102 and the female hinge piece 104 together, the cylindrical male portion 124 is slid into the cylindrical cavity 133. The opposing ends 135, 137 of the semi-circular arcs of female extension portion 129 and the space therebetween defines the range of motion of the male hinge piece 102 with respect to the female hinge piece 104.

As illustrated in FIG. 8, when the sleeve pack is assembled and the cornerpost 100 is in an open configuration, one side of extension 126 abuts against end 137 of the 180° female extension portion arc. As illustrated in phantom, when cornerpost 100 is hinged to a closed position, the other side of extension 126 will abut against end 135 of the 90° arc of female extension portion 129. Thus, the female extension portion 129 defines an approximately 90° range of motion of cornerpost 100. As illustrated in FIG. 8, in the open position of cornerpost 100, the male piece 102 and the female piece 104 extend generally perpendicular to one another. In the closed position, the male piece 102 and the female piece 104 will extend generally parallel one another so that the sleeve pack may be properly collapsed.

Preferably, pop rivets 140 extend through the channel walls 106, 130 of the male hinge piece 102 and female hinge piece 104, respectively, to secure the sleeve panels 118, 134 to cornerpost 100. As shown in FIG. 7, a pop rivet 140 may also be inserted in a cylindrical passage 125 formed within male extension portion 124. When the male and female hinge pieces, 102, 104 are assembled, the pop rivet is then inserted into either end of male extension portion 124 and the rivet head 142 is dimensioned to abut against the end of female extension portion 129 and thereby secure the female extension portion 129 between the rivets therein. Preferably, cornerpost 100 is fabricated from aluminum.

Therefore, the present invention presents sleeve packs, both rigid and collapsible, which are inexpensive to manufacture and easy to assemble and disassemble without tools. The sleeve packs disclosed herein are weather proof and able to withstand moisture and other elements without losing their supporting strength. They are lightweight yet sturdy, and the combination of the double-faced corrugated plastic and unique rigid cornerposts and doubled structures and side flaps creates a supporting structure at the corners of the sleeve pack able to withstand heavy compressive loads. Because of the ease with which the sleeve pack may be disassembled, it is subject to relatively inexpensive recycling of its component parts.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. An improved sleeve pack assembly to be used with a pallet base and cover to form a container for shipping bulk goods, the sleeve pack assembly comprising:

four rectangular vertical wall panels with inside faces and outside faces and vertical side edges, each wall panel having an elongated hinged side flap on two opposing vertical side edges, each side flap having a flap edge and being folded toward a panel face to lie adjacent the face and define a doubled panel edge structure with a securing edge along the flap edge;

four cornerposts attached to the side edges of the panels to configure the panels into a rectangular sleeve, each cornerpost being an elongated member comprising two longitudinal channel pieces hingedly attached together such that the cornerpost may flex along its length, the channel pieces each having opposing channel walls which define a vertical slot dimensioned to receive a doubled panel edge structure and side flap of a wall panel;

at least one channel wall of each channel piece having a hooking edge protruding inwardly of the slot of the channel piece, the hooking edge oriented generally perpendicular with the channel wall to abut against the securing edge of the flap and lock the side flap and doubled panel edge structure into the channel piece slot, the cornerposts holding all of the wall panels together along their vertical side edges into a rectangular sleeve with adjacent wall panels being flexible with respect to each other at the hinged cornerposts;

whereby the panels and cornerposts may be easily and quickly assembled into a collapsible sleeve pack assembly which together with a pallet base and cover forms a lightweight, sturdy and reusable shipping container.

2. The improved sleeve pack assembly of claim 1 wherein each channel piece includes a longitudinal flange thereon and the two channel pieces are hingedly joined to each other by a flexible strip connected to the longitudinal flanges to form a unitary hinged cornerpost.

3. The improved sleeve pack assembly of claim 1 wherein at least two of the panels, on opposite sides of the rectangular sleeve, have a score line extending vertically on the panel in a direction generally parallel with the elongated cornerposts, the panels flexing along the score line;

said sleeve pack assembly being collapsible by folding the opposing scored panels at the score lines toward the center of the sleeve pack assembly and hinging the cornerposts to move the other panels toward each other to sandwich the folded scored panels;

whereby the sleeve pack may be collapsed into a volume smaller than the volume of the uncollapsed sleeve pack.

4. The improved sleeve pack assembly of claim 1, wherein both opposing walls of a channel have a hooking edge protruding therefrom toward the slot to abut against a side flap securing edge and lock a panel in the cornerpost when the side flap is folded toward either panel face.

5. The improved sleeve pack assembly of claim 1 further comprising fasteners extending into the channel pieces and doubled panel edge structures to further secure the panels in the cornerpost channel slots.

6. The improved sleeve pack assembly of claim 1, at least one panel having a hand hold opening formed therein to allow gripping of the panel for easy assembly and use of the sleeve pack assembly.

7. The improved sleeve pack assembly of claim 1 wherein each channel piece of a post includes a connecting edge thereon, the post further comprising a hinge member coupled to the connecting edges to hingedly join the channel pieces and form a unitary hinged post.

8. The improved sleeve pack assembly of claim 1 wherein the adjacent panels are arranged to form a rectangular sleeve and the posts are positioned at the corners of said sleeve for collapsing the sleeve pack assembly at its corners.

9. The improved sleeve pack assembly of claim 1 wherein one channel piece functions as a male hinge piece having a male extension portion and the other channel piece functions as a female hinge piece having a female extension portion configured to receive the male extension portion in hinged engagement such that the post may flex along its length.

10. The improved sleeve pack assembly of claim 9 wherein the male extension portion includes a generally cylindrical section and the female extension portion forms a generally cylindrical channel to receive and partially surround the male extension portion in hinged engagement.

11. The improved sleeve pack assembly of claim 10 wherein the female extension portion channel has opposing edges, the edges abutting against a section of the male extension portion to allow hinged movement of the male hinge piece in a range of approximately 0–90 degrees with respect to the female hinge piece.

12. An improved sleeve pack assembly to be used with a pallet base and cover to form a container for shipping goods, the sleeve pack assembly comprising:

four rectangular vertical wall panels with inside faces and outside faces and vertical side edges, each wall panel being fabricated of double-faced corrugated plastic and having an elongated hinged side flap on two opposing vertical side edges, each side flap having a flap edge and being folded toward a panel face to lie adjacent the face and define a doubled panel edge structure with a plastic securing edge along the flap edge;

four cornerposts attached to the side edges of the panels to configure the panels into a rectangular sleeve, each cornerpost being an elongated member having two longitudinal channel sections which are joined along their length to lie generally perpendicular with each other and form a corner along the length of the member, the channel sections each having opposing channel walls which define a vertical slot dimensioned to receive a doubled panel edge structure and side flap of a wall panel;

at least one channel wall of each channel section having a hooking edge protruding inwardly of the slot of the channel section, the hooking edge oriented generally perpendicular with the channel wall to abut against the plastic securing edge of the flap to lock the side flap and doubled panel edge structure into the cornerpost slot, the cornerposts holding all of the wall panels together along their vertical side edges into a rectangular sleeve;

whereby the panels and cornerposts may be easily and quickly assembled into a sleeve pack assembly which together with a pallet base and a cover forms a lightweight, sturdy and reusable shipping container.

13. The improved sleeve pack assembly of claim 12, wherein both opposing walls of a channel have a hooking edge protruding therefrom toward the slot to abut against a side flap securing edge and lock a panel in the cornerpost when the side flap is folded toward either panel face.

14. The improved sleeve pack assembly of claim 12 further comprising fasteners extending into the channel sections and doubled panel edge structures to further secure the panel in the cornerpost channel slots.

15. The improved sleeve pack assembly of claim 12, at least one panel having a hand hold opening formed therein to allow gripping of the panel for easy assembly and use of the sleeve pack assembly.

16. An improved sleeve pack assembly to be used with a pallet base and cover to form a container for shipping bulk goods, the sleeve pack assembly comprising:

four rectangular vertical wall panels with inside faces and outside faces and vertical side edges, each wall panel having an elongated hinged side flap on two opposing vertical side edges, each side flap having a flap edge and being folded toward a panel face to lie adjacent the face and define a doubled panel edge structure with a securing edge along the flap edge;

four cornerposts attached to the side edges of the panels to configure the panels into a rectangular sleeve, each cornerpost being an elongated member comprising a male hinge piece and a female hinge piece, the male hinge piece having a male extension portion and the female hinge piece having a female extension portion configured to receive the male extension portion in hinged engagement such that the cornerpost may flex along its length, the hinge portion each having opposing channel walls which define a vertical slot dimensioned to receive a doubled panel edge structure and side flap of a wall panel;

at least one channel wall of each hinge piece having a hooking edge protruding inwardly of the slot of the hinge piece, the hooking edge oriented generally perpendicular with the channel wall to abut against the securing edge of the flap and lock the side flap and doubled panel edge structure into the hinge piece slot, the cornerposts holding all of the wall panels together along their vertical side edges into a rectangular sleeve with adjacent wall panels being flexible with respect to each other at the hinged cornerposts;

whereby the panels and cornerposts may be easily and quickly assembled into a collapsible sleeve pack assembly which together with a pallet base and cover forms a lightweight, sturdy and reusable shipping container.

17. The improved sleeve pack assembly of claim 16 wherein the male extension portion is generally cylindrical and the female extension portion forms a generally cylindrical channel to receive and partially surround the male extension portion in hinged engagement.

18. The improved sleeve pack assembly of claim 17 wherein said female extension portion channel surrounds the cylindrical male portion approximately 270 degrees around the circumference of the cylindrical male portion to contain the male portion along its length.

19. The improved sleeve pack assembly of claim 17 wherein the female extension portion channel has opposing edges, the edges abutting against a section of the male extension portion to allow hinged movement of the male hinge piece in a range of approximately 0–90 degrees with respect to the female hinge piece.

20. The improved sleeve pack assembly of claim 16 wherein the female extension portion is configured to slidably receive the male extension portion.

21. The improved sleeve pack assembly of claim 20 further comprising a rivet positioned at each end of the cornerpost, each rivet connected to an end of the male extension portion and abutting against an end of the female extension portion to hold the hinge pieces together.

22. An improved sleeve pack assembly to be used with a pallet base and cover to form a container for shipping bulk goods, the sleeve pack assembly comprising:

a plurality of rectangular vertical panels with inside faces and outside faces and vertical side edges, each panel having an elongated hinged side flap on at least one vertical side edge, each side flap having a flap edge and being folded toward a panel face to lie adjacent the face and define a doubled panel edge structure with a securing edge along the flap edge;

a plurality of posts attached to the side edges of adjacent panels to couple adjacent panels together for forming a sleeve, each post being an elongated member comprising two longitudinal channel pieces hingedly attached together such that the post may flex along its length, the channel pieces each having opposing channel walls which define a vertical slot dimensioned to receive a doubled panel edge structure and side flap of a panel;

at least one channel wall of each channel piece having a hooking edge protruding inwardly of the slot of the channel piece, the hooking edge oriented generally perpendicular with the channel wall to abut against the securing edge of the flap and lock the side flap and doubled panel edge structure into the channel piece slot, the posts holding the adjacent panels together along their vertical side edges for forming a sleeve with adjacent wall panels being flexible with respect to each other at the hinged post;

whereby the panels and posts may be easily and quickly assembled into a collapsible sleeve pack assembly which together with a pallet base and cover forms a lightweight, sturdy and reusable shipping container.

23. A method of forming an improved collapsible sleeve pack assembly comprising:

providing four rectangular vertical wall panels each having inside and outside faces and vertical side edges;

folding two opposing vertical side edges of each panel along longitudinal fold lines toward one face of the panel to form side flaps having a flap edge, the folded side flaps lying adjacent the panel face to define a doubled panel edge structure with a securing edge along the flap edge;

providing four elongated cornerpost structures, each cornerpost structure comprising two longitudinal channel pieces including opposing channel walls which define a vertical slot, at least one channel wall having a hooking edge protruding inwardly of the slot and oriented generally perpendicular with the channel wall;

pressing the doubled panel edge structures and flaps of the panels into the slots of the cornerposts, the entire end flap of each panel edge being inserted into a cornerpost channel slot such that the hooking edge abuts against the securing edge of the flap and holds the doubled panel edge structure in the cornerpost;

hingedly attaching each channel piece together to form a unitary cornerpost structure with flexible channel pieces which allow adjacent panels to flex with respect to each other, the unitary cornerpost structures holding the panels together in a unitary sleeve pack;

whereby the resulting sleeve pack assembly is lightweight, sturdy, and reusable and may be collapsed by hinging the panels at the cornerpost structures.

24. The method of claim 23 wherein each channel piece includes a longitudinal flange thereon, the method further comprising joining the longitudinal flanges of two channel pieces together with a flexible strip to form the unitary hinged cornerpost structure.

25. The method of claim 23 further comprising:

placing fasteners through the cornerposts and double panel edge structures to further secure the panels in the cornerpost.

26. The method of claim 23 further comprising:

scoring at least two of the opposing wall panels with vertical score lines such that the scored panels may be folded along the fold lines when the sleeve pack assembly is collapsed.

27. A method of forming an improved rigid sleeve pack assembly comprising:

providing four rectangular vertical wall panels each having inside and outside faces and vertical side edges, the panels being fabricated of double-faced corrugated plastic;

folding two opposing side edges of each panel along longitudinal fold lines toward one face of the panel to form side flaps having a flap edge, the side flaps lying adjacent the panel face to define a doubled panel edge structure with a securing edge along the flap edge;

providing four elongated cornerpost structures, each cornerpost structure having two generally perpendicular longitudinal channel sections which are attached along their length to form a corner, each channel section including opposing channel walls which define a vertical slot, at least one channel wall having a hooking edge protruding inwardly of the slot and oriented generally perpendicular with the channel wall;

pressing the doubled panel edge structures and flaps of the panels into the slots of the cornerpost structures, the entire end flap of each panel edge being inserted into a such that the hooking edge abuts against the securing edge of the flap and holds the doubled panel edge structure in the cornerpost structure;

whereby the resulting sleeve pack assembly is lightweight, sturdy and reusable.

28. The method of claim 27 further comprising:

placing fasteners through the cornerposts and doubled panel edge structures to further secure the panels in the cornerposts.

29. A method of forming an improved collapsible sleeve pack assembly comprising:

providing a plurality of rectangular wall panels each having inside and outside faces and vertical side edges;

folding an opposing vertical side edge of adjacent panels along a longitudinal fold line toward one face of the panel to form side flaps having a flap edge, the folded side flaps lying adjacent the panel face to define a doubled panel edge structure with a securing edge along the flap edge;

providing a plurality of posts for holding the panels together to form a sleeve, each post comprising two longitudinal channel pieces including opposing channel walls which define a vertical slot, at least one channel wall having a hooking edge protruding inwardly of the slot and oriented generally perpendicular with the channel wall;

pressing the doubled panel edge structures and flaps of the adjacent panels into the slots of the posts, the entire end flap of each panel edge being inserted into a post channel slot such that the hooking edge abuts against the securing edge of the flap and holds the doubled panel edge structure in the post;

hingedly attaching each channel piece together to form a unitary post structure with flexible channel pieces which allow adjacent panels to flex with respect to each other, the unitary post structures holding the panels together in a unitary sleeve pack;

whereby the resulting sleeve pack assembly is lightweight, sturdy, and reusable and may be collapsed by hinging the panels at the post structures.

30. The method of claim 29 wherein each channel piece of a post includes a connecting edge thereon, the method further comprising coupling the connecting edges together with a hinge member to hingedly attach the channel pieces and form the unitary hinged post structure.

31. The method of claim 29 further comprising arranging the adjacent panels to form a rectangular sleeve and positioning the hinged posts at the corners of said sleeve for collapsing the sleeve pack assembly at its corners.

* * * * *

UNITED STATES PATENT AND TRADEMARK OFFICE

CERTIFICATE OF CORRECTION

PATENT NO. : 5,538,178

DATED : July 23, 1996

INVENTOR(S) : Robert M. Zink and Donald J. Bazany

It is certified that error appears in the above-indentified patent and that said Letters Patent is hereby corrected as shown below:

In Column 16, lines 9 and 10 it reads "into a such that the", and it should read --into a cornerpost channel slot such that the--.

Signed and Sealed this

Eighth Day of April, 1997

*Attest:*

Bruce Lehman

BRUCE LEHMAN

*Attesting Officer*

*Commissioner of Patents and Trademarks*